US006309529B1

(12) United States Patent
Hara et al.

(10) Patent No.: US 6,309,529 B1
(45) Date of Patent: Oct. 30, 2001

(54) METHOD FOR PRODUCING SPUTTERING TARGET MATERIAL

(75) Inventors: Noriaki Hara; Somei Yarita; Ken Hagiwara; Ritsuya Matsuzaka, all of Kanagawa-ken (JP)

(73) Assignee: Tanaka Kikinozoku Kogyo K.K., Tokyo (JP)

( * ) Notice: Subject to any disclaimer, the term of this patent is extended or adjusted under 35 U.S.C. 154(b) by 0 days.

(21) Appl. No.: 09/463,981

(22) PCT Filed: Jun. 16, 1999

(86) PCT No.: PCT/JP99/03192

§ 371 Date: Feb. 15, 2000

§ 102(e) Date: Feb. 15, 2000

(87) PCT Pub. No.: WO99/66098

PCT Pub. Date: Dec. 23, 1999

(30) Foreign Application Priority Data

Jun. 16, 1998 (JP) ..... 10-168762

(51) Int. Cl.[7] ..... C25C 3/00
(52) U.S. Cl. ..... 205/354; 205/363; 205/367
(58) Field of Search ..... 205/354, 363, 205/367

(56) References Cited

U.S. PATENT DOCUMENTS

| | | | | |
|---|---|---|---|---|
| 4,081,335 | * | 3/1978 | Von Stutterhelm et al. | 205/138 |
| 4,180,480 | * | 12/1979 | Jameson et al. | 106/1.11 |
| 4,274,926 | | 6/1981 | Simon et al. . | |
| 4,892,631 | * | 1/1990 | White | 205/565 |

FOREIGN PATENT DOCUMENTS

| | | |
|---|---|---|
| 286175 | 10/1988 | (EP) . |
| 9-41131 | 2/1997 | (JP) . |
| 11-158612 | 6/1999 | (JP) . |

* cited by examiner

*Primary Examiner*—Donald R. Valentine
(74) *Attorney, Agent, or Firm*—Arent Fox Kintner Plotkin & Kahn, PLLC

(57) ABSTRACT

The invention provides a method for producing a sputtering target material including electrolyzing a molten salt mixture containing a precious metal salt and a solvent salt, to thereby deposit a precious metal or a precious metal alloy. The method enables simplification of production steps and produces high-purity target materials. In addition, the electrodeposited precious metal or precious metal alloy is heat-treated at a temperature of at least 800° C. but lower than the melting point of the precious metal, to thereby produce a target material of higher purity.

11 Claims, 1 Drawing Sheet

METHOD FOR PRODUCING SPUTTERING TARGET MATERIAL

TECHNICAL FIELD

The present invention relates to a method for producing a sputtering target material, and more particularly to a method for producing a sputtering target material which is used for producing precious metal thin film.

BACKGROUND ART

Recently, a trend toward size reduction of electronic and electric apparatus has become more pronounced, along with demand for enhancing integration of LSIs, which are employed to control functions of these apparatus. In other words, electric circuits as well as each and every electronic element must have a higher degree of integration.

In the course of enhancing integration, precious metals such as ruthenium or iridium have been employed as materials which are more useful for providing an electrode to a wafer of semiconductor devices, since precious metals provide a thin-film electrode having excellent electrode properties.

A variety of methods, such as vacuum vapor deposition and CVD, have been employed for forming thin film contained in semiconductor devices. Of these methods, sputtering, which is one type of physical vapor deposition method, is most widely employed at present. Sputtering is a method for forming a metal thin film, and comprises the steps of causing particles such as argon ions to collide with a target constituting the material of a thin film to be produced, and depositing metal particles on a substrate released by exchange of momentum. Therefore, since the properties of the formed thin film are apt to vary depending on characteristics of the target material, such as purity, high purity is a critical requirement for a target material.

A precious metal target material has conventionally been produced through either one of the following typical methods; i.e., powder metallurgy, in which precious metal powder is shaped and sintered through hot-pressing (HIP); and a casting method in which a compact of ruthenium powder formed by hot-pressing is melted in a crucible by means of irradiation with an electron beam and solidified.

In the case of the casting method, the purity of a target material is easily controlled, to thereby obtain a target material of comparatively high purity. However, much energy is required for melting a precious metal having a high melting point, and during casting a raw material must be provided in an amount greater than that found in actual products. In addition, the method has a drawback in that the number of production steps is high, to thereby elevate production cost and product price.

Powder metallurgy can produce a sputtering target material at lower energy cost than can casting. Furthermore, powder metallurgy has an advantage of providing high yield. However, a binder cannot be used during production of a sputtering target material through powder metallurgy, since the material must have high purity. Thus, a metal powder constituting a sputtering target material must be sintered and solidified without use of a binder. Without use of a binder, appropriately shaping and sintering a metal powder is very difficult, as is determining parameters for several process conditions.

Even though a powder can be sintered without use of a binder, a raw material powder easily becomes contaminated or easily adsorbs impurities, and very careful storage of the raw material for producing a sputtering target material is required. Thus, when a sputtering target material is produced through powder metallurgy, it is difficult to produce a target material of uniform structure and purity which permits use of the target for producing an electronic element in the electronic industry, unless production conditions, including storage of raw material powder, are very strictly controlled. In addition, production through powder metallurgy comprises cumbersome steps, such as producing a raw material powder and hot-pressing. These steps increase production cost, to thereby disadvantageously elevate product price.

As described above, although several practical methods for producing a precious metal target material have been developed, these methods are not necessarily satisfactory in view of product properties and production cost. Thus, demand exists for a more efficient method for producing a precious metal target material.

DISCLOSURE OF THE INVENTION

In view of the foregoing, an object of the present invention is to provide a method for producing a sputtering target material, which method simplifies production steps and produces a high-purity target material.

The present inventors have conducted earnest studies in order to attain the above object, and have found that a sputtering target material can be directly produced through electrodeposition of a precious metal or a precious metal alloy from a molten salt mixture comprising a precious metal salt and a solvent salt.

The invention as recited in claim 1 is drawn to a method for producing a sputtering target material which comprises electrolyzing a molten salt mixture comprising a precious metal salt and a solvent salt, to thereby obtain a precious metal or a precious metal alloy serving as the target material. Briefly, the method enables direct production of a sputtering target material through electrolysis of a molten salt.

The reason why a molten salt mixture comprising a precious metal salt and a solvent salt is used will be described. If a high-purity raw material compound is used and appropriate electrolysis conditions are employed, a high-purity precious metal can be deposited, to thereby directly provide a high-quality target material through a single step. Furthermore, in the present invention, since a precious metal of interest is deposited electrochemically, a metal component which is more reactive than a precious metal is not mingled in the formed deposit. Therefore, the present invention provides a method for producing a sputtering target material containing a considerably low amount of a radioactive isotope, such as an isotope of thorium or an isotope of uranium, which may affect characteristics of a semiconductor. In contrast, during production through casting, metallic impurities such as radioactive isotopes may be mingled into the formed deposit regardless of the electrochemical properties of the impurities. Thus, the method of the present invention provides an excellent effect for preventing incorporation of such impurities.

Another advantage of electrolysis of a molten salt employed in the present invention is that a metal of interest can be obtained through electrodeposition performed at a temperature much lower than the melting point of a precious metal without requiring a high temperature such that the precious metal melts. Briefly, a target material can be produced with less energy than that required in casting. In addition, in the present invention, molds having a shape corresponding to the target of interest are not required, and a target material having a shape nearly equal to that of a final target is directly obtained by employing a cathode having a shape corresponding to that of the final target. In a final step, the thus-obtained target material is subjected to simple physical polishing, to thereby obtain a final product. The number of these steps carried out in the method of the present invention is much lower than that carried out in conventional methods.

The method of the present invention will next be compared with steps carried out in powder-sintering. The surface of powder which is sintered in the method is easily oxidized and contaminated. Therefore, the powder must be stored with maximum care under rigorous control. From the general view of fabrication process, a powder-sintering method requires a number of steps such as adjusting the particle size of powder, shaping the powder, and sintering the shaped powder. In contrast, the method of the present invention employing electrolysis of a molten salt can omit a considerable number of steps for producing a sputtering target.

In the method of the present invention, the term "solvent salt" refers to a molten salt such as a chloride or a cyanide compound which serves as an ionic conductor during electrolysis. Particularly, as is recited in claim 3, a ternary salt mixture comprising sodium chloride, potassium chloride, and cesium chloride is preferred as a solvent salt. Cyanide compounds are not preferably used on an industrial scale, since these compounds are difficult to handle during operation due to their toxicity and may affect the human body and cause an environmental problem which has recently become of concern.

The ternary salt mixture comprising sodium chloride, potassium chloride, and cesium chloride can easily dissolve a precious metal salt. By use of a multi-component salt bath, an impurity-free deposit having low internal stress can be obtained. The molten salt mixture preferably comprises sodium chloride, potassium chloride, and cesium chloride in proportions of 25–35 mol %, 20–30 mol %, and 40–50 mol %, respectively, particularly preferably 30.0 mol %, 24.5 mol %, and 45.5 mol %, respectively. When the compositional proportions fall within the given ranges, a precious metal salt easily dissolves in the molten salt.

The temperature of the molten salt during electrolysis is preferably 450° C.–650° C., particularly preferably 500° C.–580° C. When the temperature is 400° C. or lower, the molten salt is easily solidified, to thereby fail to maintain the molten state, whereas when the temperature is 700° C. or higher, a uniform deposit of columnar structure is not produced. A temperature within the range of 500° C. to 580° C. is most preferred, since a target material having excellent smoothness is obtained through electrolysis at a temperature falling within the range.

Claim 2 is drawn to a method for producing a sputtering target material as claimed in claim 1 of the present invention, the precious metal salt may be an iridium salt or a ruthenium salt. Iridium and ruthenium salts are particularly preferred, since production of iridium and ruthenium through typical electrolysis of an aqueous solution has conventionally been difficult in view of cost and control of operation, and use of a molten salt enables the method for producing a target material through electrolysis to be commercially acceptable. The concentration of a precious metal (metal concentration) in the molten salt is preferably 0.5–10.0 wt. %, particularly preferably 3.0–6.0 wt. %.

The method for producing a sputtering target material according to the present invention employs an apparatus for electrolyzing a molten salt, which apparatus comprises a hollow cylindrical vessel having an opening at the top; a flange having an inlet for inserting an electrode and serving as a cap for the cylindrical vessel; a graphite-made electrolytic tank; an exhausting chamber for inserting or removing a cathode portion; and rotating means for rotating a plating substrate.

Either a self-dissolving or non-dissolving anode may be used as an anode employed in the graphite-made electrolytic tank. When a self-dissolving anode is used, preparation of a precious metal component during electrolysis is not required and operation for preparing an electrolysis bath may be omitted. Specifically, a self-dissolving anode formed of a precious metal or precious metal alloy of interest is electrochemically dissolved and the metal of interest is electrochemically deposited on a cathode, to thereby produce with comparative ease a high-purity target material formed of the precious metal or precious metal alloy. In this case, the self-dissolving anode is not necessarily of high purity, and there may be used a material having a purity lower than that of the target material of interest; e.g., a target material already used for sputtering.

The current density during electrolysis of a molten salt is preferably 0.5–10 A/dm$^2$. When the current density is in excess of the upper limit, the structure of the obtained target becomes coarse, whereas when it is lower than the lower limit, deposition rate is disadvantageously slow, which is industrially inappropriate.

In addition to direct current, pulse current and PR (positive reverse) current may be used as supplied current in the present invention. Particularly, supplying PR current advantageously enhances the smoothness of the surface of the deposited product, to thereby make a post-polishing step easier.

Through the method of the present invention comprising electrolysis of a molten salt, target materials formed of a precious metal alloy as well as a single component precious metal can be produced with ease by modifying the composition of the molten salt bath. Specifically, a high-purity target material formed of a precious metal alloy can also be produced with comparative ease, if a self-dissolving anode formed of the precious metal alloy of interest is used in a manner similar to deposition of a single component precious metal through electrochemical dissolution of the precious metal anode while the precious metal component is supplied to the molten salt.

The precious metal or precious metal alloy which is electrodeposited through the method according to the present invention may be subjected to a heat treatment as claimed in claim 4 so as to remove an alkali metal contained in the deposit, to thereby further enhance the purity of the formed target material. Since the method according to the present invention comprises electrodeposition from a molten salt containing an alkali metal salt, the produced sputtering target material may contain an alkali metal as an impurity in an amount of some hundred ppb. The impurity may adversely affect properties of a semiconductor having the thin film formed by use of the target material. Thus, the heat treatment imparts higher purity to the formed target material, to thereby provide favorable properties to the formed thin film.

The heat treatment is preferably carried out at 800° C. or higher but lower than the melting point of the employed precious metal, since the treatment is preferably carried out at a temperature higher than the recrystallization temperature of the precious metal.

The heat treatment is preferably carried out in vacuum or under an inert gas such as nitrogen or argon as recited in claim 5, in order to prevent formation of oxide film on a target material during heat treatment. If the treatment is carried out in air, impurities are mingled into the target material from a heating furnace, to thereby impair the effect of heat treatment. In addition, an alkali metal impurity is more effectively removed through heat treatment in vacuum.

BEST MODE FOR CARRYING OUT THE INVENTION

Figure 1:
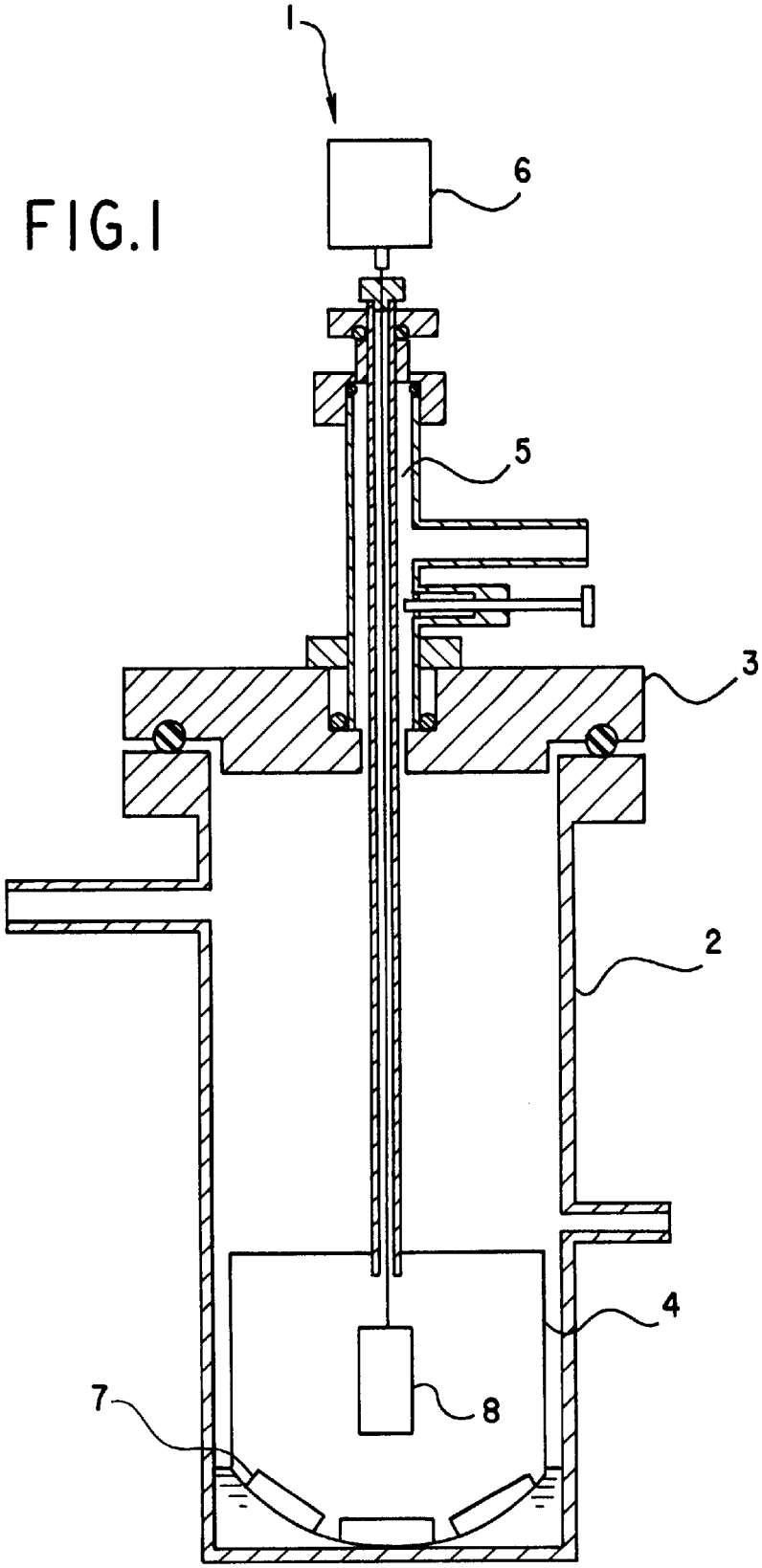
FIG. 1 is a schematic structural diagram of an apparatus for electrolysis of a molten salt employed in one embodiment of the present invention.

The present invention will next be described with reference to embodiments for carrying out the invention.

Embodiment 1

The method for producing a sputtering target material according to the present invention was carried out by means of an apparatus 1 for electrolysis of a molten salt shown in FIG. 1. As shown in FIG. 1, the apparatus 1 comprises a hollow cylindrical vessel 2 having an opening at the top; a flange 3 having an inlet for inserting an electrode and serving as a cap for the cylindrical vessel; a graphite-made electrolytic tank 4; an exhausting chamber 5 for inserting or removing an object to be plated; and rotating means 6 for rotating a cathode portion.

In the apparatus 1 for electrolysis of a molten salt shown in FIG. 1, ruthenium plates 8 were used as self-dissolving anodes. These ruthenium 8 plates were disposed such that they maintained contact with a bottom portion of the electrolytic tank 4. Electric current was supplied via the electrolytic tank 4 by use of rod-shaped graphite 8 as a cathode, to thereby perform electrolysis of a molten salt. The composition of the molten salt mixture for a ruthenium target material is shown in Table 1.

TABLE 1

| Salt component | Weight/g |
|---|---|
| sodium chloride | 1577.9 |
| potassium chloride | 1241.3 |
| cesium chloride | 6894.3 |
| potassium chlororuthenate | 765.1 |

Electrodeposition of the molten salt was carried out under the following conditions: bath temperature of 520° C., cathodic current density of 2 A/dm$^2$, and a deposition time of 150 h, to thereby obtain a deposit having a thickness of 3 mm. The deposit was washed with hydrochloric acid and removed from the graphite electrode, to thereby obtain disk-shaped ruthenium plates.

The shaped ruthenium plates were placed in a vacuum furnace. The atmosphere of the furnace was purged by use of nitrogen and evacuated by use of a vacuum pump so as to attain a pressure as low as $1\times10^{-2}$ torr. The ruthenium plates were heated at 1080° C. for 24 hours under the above conditions in order to enhance purity.

The concentrations of alkali metals contained in the ruthenium target material as measured after electrodeposition and after heat treatment of the deposited samples are shown in Table 2. Measurement was carried out by a GD-MS method. As is clear from Table 2, the concentration of alkali metal of the heat-treated target material was reduced to approximately 1/100–1/10 that of the deposited product. Thus, the target material produced through the method of the invention was found to be formed of very high-purity precious metal.

TABLE 2

| | Amount of impurity element/ppb | |
|---|---|---|
| Impurity element | Before heat treatment | After heat treatment |
| sodium | 240 | 5 |
| potassium | 7800 | 70 |
| cesium | 70000 | 6500 |
| lithium | not detected | not detected |
| calcium | 20 | not detected |
| thorium | not detected | not detected |
| uranium | not detected | not detected |

By use of the ruthenium target material which had been produced through the method according to the present invention, thin films were produced through sputtering. The concentration of impurities was measured in the produced thin films. The results are shown in Table 3. For comparison, the impurity concentrations of thin films formed by use of sputtering target materials produced through casting and powder metallurgy are also shown in Table 3. As is clear from Table 3, the thin film formed by use of the sputtering target material produced through the method according to the present invention has an impurity concentration lower than those of thin films formed by use of sputtering target materials produced through other methods. Thus, the target material produced through the method of the invention provides a thin film of excellent quality.

TABLE 3

| | Amount of impurity element/ppb | | |
|---|---|---|---|
| Impurity element | Molten salt electrolysis | Casting | Powder metallurgy |
| sodium | 1 | 10 | 2 |
| potassium | ≦20 | ≦20 | ≦20 |
| cesium | ≦5 | ≦5 | ≦5 |
| lithium | 1 | 1 | 2 |
| calcium | 50 | 200 | 200 |
| thorium | ≦0.5 | ≦0.5 | ≦0.5 |
| uranium | ≦0.5 | ≦0.5 | ≦0.5 |

Embodiment 2

In Embodiment 2, another ruthenium target material was produced under conditions different from those for deposition of ruthenium. Specifically, ruthenium chloride was added in a predetermined amount to a molten salt mixture (solvent) comprising sodium chloride (NaCl), potassium chloride (KCl), and cesium chloride (CsCl) in proportions of 30 mol %, 24.5 mol %, and 45.5 mol %, respectively, to thereby adjust the concentration of precious metal. From the thus-prepared molten salt samples, ruthenium was deposited at a variety of salt temperatures and current densities. The employed self-dissolving anode was formed of high-purity ruthenium having a precious metal (other than Ru) content of 10 ppm or less. The results are shown in Table 4.

TABLE 4

| Test No. | Composition of molten salt NaCl | KCl | CsCl | Amount of metal added | Overall weight | Temp. of molten salt | Current density | Deposition time | Thickness of target material |
|---|---|---|---|---|---|---|---|---|---|
| NO. 1 | 30% | 24.5% | 45.5% | 0.4 wt. % | 60 kg | 530° C. | 1 A/dm$^2$ | 240 h | 2.5 mm |
| NO. 2 | 30% | 24.5% | 45.5% | 0.8 wt. % | 60 kg | 530° C. | 2 A/dm$^2$ | 240 h | 5 mm |
| NO. 3 | 30% | 24.5% | 45.5% | 1.6 wt. % | 150 kg | 540° C. | 3 A/dm$^2$ | 160 h | 5 mm |
| NO. 4 | 30% | 24.5% | 45.5% | 4 wt. % | 150 kg | 530° C. | 4 A/dm$^2$ | 120 h | 5 mm |
| NO. 5 | 30% | 24.5% | 45.5% | 8 wt. % | 60 kg | 580° C. | 8 A/dm$^2$ | 60 h | 5 mm |

The impurity element content of target materials produced under the above conditions was measured in a manner similar to that employed in Embodiment 1. All samples had a total impurity content of 10 ppm or less.

Thus, the results show that the present invention can provide precious metal target materials having a desired thickness by selection of appropriate conditions for electrolysis.

Embodiment 3

In Embodiment 3, an iridium target material was produced by use of the same apparatus as employed in Embodiment 1. Thus, repetition of the description in relation to the method for production is omitted, and only conditions different from those employed in Embodiment 1 will be described. In Embodiment 3, a molten salt mixture having a composition as shown in Table 5 was used for depositing iridium.

TABLE 5

| Salt component | Weight/g |
|---|---|
| sodium chloride | 1420.0 |
| potassium chloride | 1643.8 |
| cesium chloride | 6894.3 |
| potassium chloroiridate | 426.5 |

Electrodeposition of the molten salt was carried out under the following conditions: bath temperature of 600° C., cathodic current density of 3 A/dm$^2$, and deposition time of 100 h, to thereby obtain a deposit having a thickness of 3 mm. The iridium deposit was washed with acid, shaped, and heat-treated in the same manner as employed in Embodiment 1, to thereby remove impurities from the material.

Embodiment 4

In Embodiment 4, another iridium target material was produced under conditions different from those for deposition of iridium. The composition of the molten salt was similar to that employed in Embodiment 2, and iridium chloride was added to the molten salt in a predetermined amount, to thereby adjust the concentration of precious metal. The results are shown in Table 5.

TABLE 5

| Test No. | Composition of molten salt NaCl | KCl | CsCl | Amount of metal added | Overall weight | Temp. of molten salt | Current density | Deposition time | Thickness of target material |
|---|---|---|---|---|---|---|---|---|---|
| NO. 1 | 30% | 24.5% | 45.5% | 1 wt. % | 60 kg | 600° C. | 1 A/dm$^2$ | 240 h | 2.5 mm |
| NO. 2 | 30% | 24.5% | 45.5% | 4 wt. % | 60 kg | 520° C. | 2 A/dm$^2$ | 240 h | 5 mm |
| NO. 3 | 30% | 24.5% | 45.5% | 6 wt. % | 60 kg | 530° C. | 3 A/dm$^2$ | 160 h | 5 mm |
| NO. 4 | 30% | 24.5% | 45.5% | 10 wt. % | 60 kg | 580° C. | 4 A/dm$^2$ | 60 h | 2.5 m |

Measurement of the impurity element content of the target materials produced in Embodiment 4 revealed that all target materials had properties which permit industrial use.

INDUSTRIAL APPLICABILITY

According to the present invention, a sputtering target material comprising a precious metal or a precious metal alloy can be produced by means of comparatively easy production steps. In addition, the method of the present invention comprising electrodeposition provides a target material completely free of radioactive isotopes, such as a thorium isotope or a uranium isotope, and also provides a very high-purity precious metal sputtering target material through an additional heat treatment of the deposited product so as to remove alkali metal contained in the deposited product in a microquantity. Furthermore, the target materials produced by the method according to the present invention provide high-quality thin film of low impurity content.

What is claimed is:

1. A method for producing a sputtering target material which method comprises electrolyzing a molten salt mixture comprising a precious metal salt and a solvent salt, to thereby cause deposition of a precious metal or a precious metal alloy;

wherein the precious metal salt is an iridium salt or a ruthenium salt.

2. A method for producing a sputtering target material according to claim 1, wherein the solvent salt is a mixture of sodium chloride, potassium chloride, and cesium chloride.

3. A method for producing a sputtering target material, wherein the precious metal or the precious metal alloy caused to be electrodeposited through the method as recited in claim 2 is subjected to a heat treatment at 800° C. or higher but lower than the melting point of the precious metal.

4. A method for producing a sputtering target material, wherein the precious metal or the precious metal alloy caused to be electrodeposited through the method as recited in claim 2 is subjected to a heat treatment at 800° C. or higher but lower than the melting point of the precious metal in vacuum, to thereby remove alkali metal impurities.

5. A method for producing a sputtering target material, wherein the precious metal or the precious metal alloy caused to be electrodeposited through the method as recited in claim 1 is subjected to a heat treatment at 800° C. or higher but lower than the melting point of the precious metal.

6. A method for producing a sputtering target material, wherein the precious metal or the precious metal alloy caused to be electrodeposited through the method as recited in claim 1 is subjected to a heat treatment at 800° C. or higher but lower than the melting point of the precious metal in vacuum, to thereby remove alkali metal impurities.

7. A method for producing a sputtering target material which method comprises electrolyzing a molten salt mixture comprising a precious metal salt and a solvent salt, to thereby cause deposition of a precious metal or a precious metal alloy;

wherein the solvent salt is a mixture of sodium chloride, potassium chloride, and cesium chloride.

8. A method for producing a sputtering target material, wherein the precious metal or the precious metal alloy caused to be electrodeposited through the method as recited in claim 7 is subjected to a heat treatment at 800° C. or higher but lower than the melting point of the precious metal.

9. A method for producing a sputtering target material, wherein the precious metal or the precious metal alloy caused to be electrodeposited through the method as recited in claim 7 is subjected to a heat treatment at 800° C. or higher but lower than the melting point of the precious metal in vacuum, to thereby remove alkali metal impurities.

10. A method for producing a sputtering target material which method comprises electrolyzing a molten salt mixture comprising a precious metal salt and a solvent salt, to thereby cause deposition of a precious metal or a precious metal alloy;

wherein the precious metal or the precious metal alloy caused to be electrodeposited is subjected to a heat treatment at 800° C. or higher but lower than the melting point of the precious metal.

11. A method for producing a sputtering target material, wherein a precious metal or a precious metal alloy caused to be electrodeposited through a method for producing a sputtering target material which method comprises electrolyzing a molten salt mixture comprising a precious metal salt and a solvent salt, to thereby cause deposition of a precious metal or a precious metal alloy; is subjected to a heat treatment at 800° C. or higher but lower than the melting point of the precious metal in vacuum, to thereby remove alkali metal impurities.

* * * * *